US006814691B1

(12) United States Patent
Kuo

(10) Patent No.: US 6,814,691 B1
(45) Date of Patent: Nov. 9, 2004

(54) SECURED MOUNT FOR A BODY INVERSION EXERCISER

(76) Inventor: Chung Jen Kuo, 205 Mingfong Rd., Yangmei, Taoyuan County (TW), 326

( * ) Notice: Subject to any disclaimer, the term of this patent is extended or adjusted under 35 U.S.C. 154(b) by 0 days.

(21) Appl. No.: 10/242,138

(22) Filed: Sep. 9, 2002

(51) Int. Cl.[7] ..... A63B 26/00
(52) U.S. Cl. ..... 482/145; 482/146; 482/147
(58) Field of Search ..... 482/145–148, 482/907, 908

(56) References Cited

U.S. PATENT DOCUMENTS 4,515,152 A * 5/1985 Teeter ..... 128/75
5,551,937 A * 9/1996 Kwo ..... 482/144
5,967,956 A * 10/1999 Teeter ..... 482/144

* cited by examiner

*Primary Examiner*—Nicholas D. Lucchesi
*Assistant Examiner*—L. Amerson

(57) ABSTRACT

A supporting mount for a tilting body inversion frame having standing means and spaced trunnion-bearing plates in an elevated position for bearing the trunnions carried by the tilting body inversion frame. Each of the trunnion-bearing plates has a blind slot for receiving and bearing the trunnions. At least one of the trunnion-bearing plates further include a keeper movable relative to the trunnion-bearing plate between locking position and open positions. The keeper has at one end a hook portion which in locking position secures the respective trunnion in bearing engagement, and at the other end a lever portion extending away from the trunnion-bearing plate, and in-between an axial portion through which the keeper is pivotally connected onto the outer side and proximate to the upper end of the trunnion-bearing plate.

2 Claims, 10 Drawing Sheets

SECURED MOUNT FOR A BODY INVERSION EXERCISER

BACKGROUND OF THE INVENTION

1. Field of the Invention

This invention relates to a supporting mount with safety securing means for a tilting body inversion exerciser.

2. Prior Art

Tilting body inversion exercisers are known in the art, such as U.S. Pat. No. 5,551,973 by the present inventor and U.S. Pat. No. 4,515,152 by Teeter. In particular, a supporting mount with safety securing means for a tilting body inversion frame has also been disclosed in U.S. Pat. No. 5,967,956 by Teeter. The Teeter device provides a securing mechanism which adds no inconvenience during mounting the tilting inversion frame. However, from a safety point of view, it is not reliable enough. Further, in the Teeter device it is much more difficult to dismount the tilting inversion frame than to mount it because the portion provided for manipulation is difficult to access.

BRIEF SUMMARY OF THE INVENTION

An object of the present invention is to improve the safety of use of a tilting body inversion exerciser in case a person exercising may execute more or less violent maneuvers.

Another object of the present invention is to provide a safe tilting body inversion exerciser which can be mounted and demounted quickly and easily.

A further object of the present invention is to allow easy observation of the status of the safety mechanism in use.

The foregoing objects are achieved by adding a pivotal hook shaped keeper coupled to the outer side and proximate to the upper end of the supporting mount. Such location provides excellent visibility and accessibility. The hook portion allows barring movement of the trunnion of the tilting body inversion frame from bearing engagement with the supporting mount. The keeper includes at the other end of the hook portion a short lever portion extending away from the supporting mount for easy release of the tilting body inversion frame. When re-mounting the tilting inversion frame, the hook portion is in a higher position than the top edge of the supporting mount, allowing the user to conveniently push it down to the locking position.

DETAILED DESCRIPTION

Figure 1:
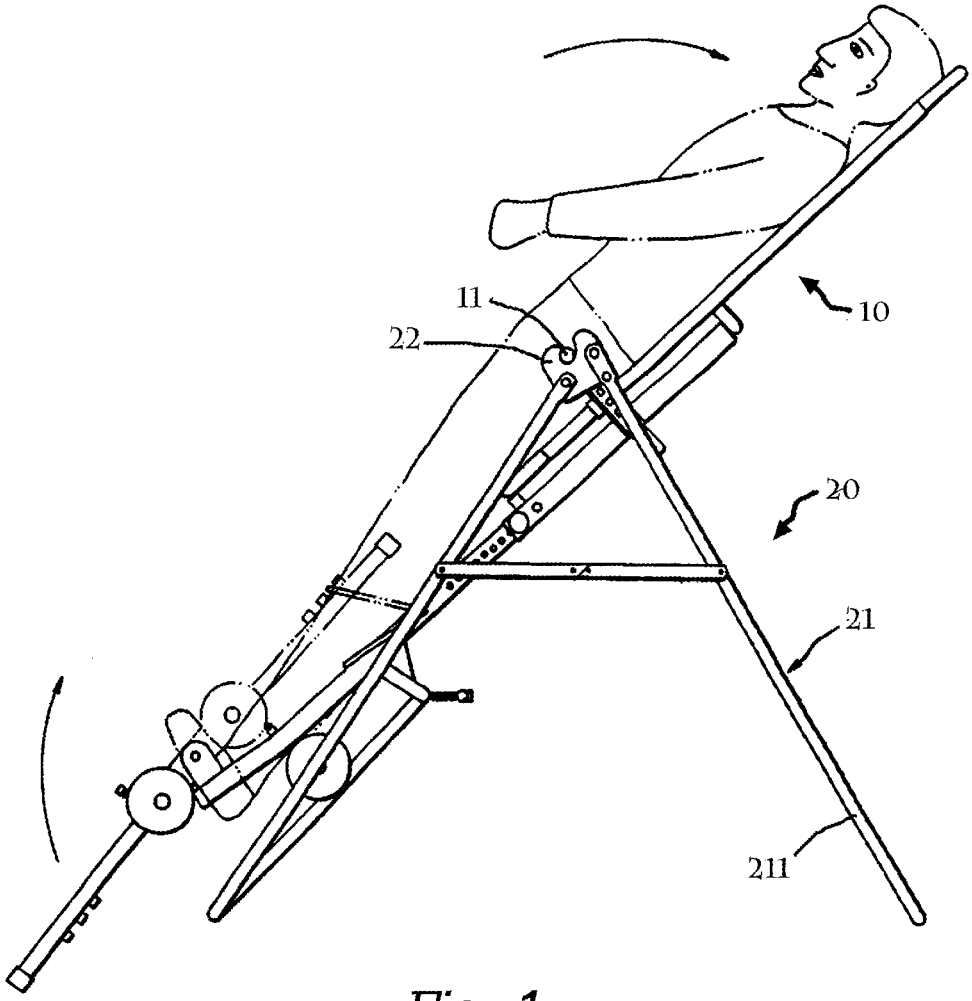
FIG. 1 is a side elevation of the tilting body inversion exerciser.
Figure 2:
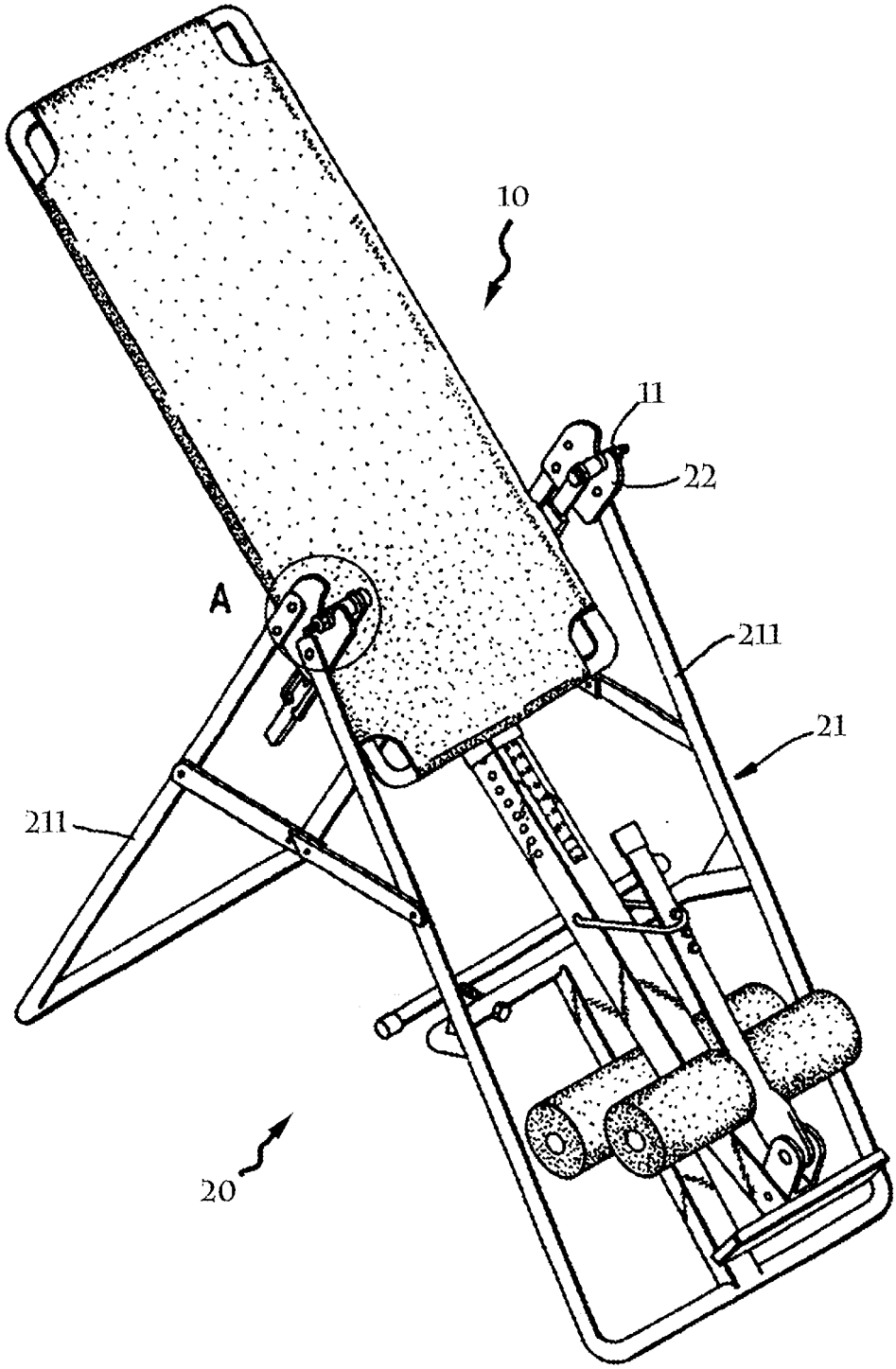
FIG. 2 is a perspective view of the tilting body inversion exerciser.

FIGS. 1 and 2 shows a tilting body inversion frame type exerciser including a tilting body inversion frame 10 and a supporting mount 20. Such tilting body inversion frame type exerciser is known in the art, such as U.S. Pat. No. 5,551,973 by the present inventor and therefore only the improvement made by the present invention will be discussed in this specification. The tilting inversion frame 10 has fixing means for securing the person exercising on it during the full exercise course. The supporting mount 20 comprises standing means 21 having side stands 211, and spaced trunnion-bearing plates 22 coupled to the upper portion of respective side stands 211. The tilting inversion frame 10 is located between and supported by the side stands 211 via the trunnion-bearing plates 22.

Figure 3:
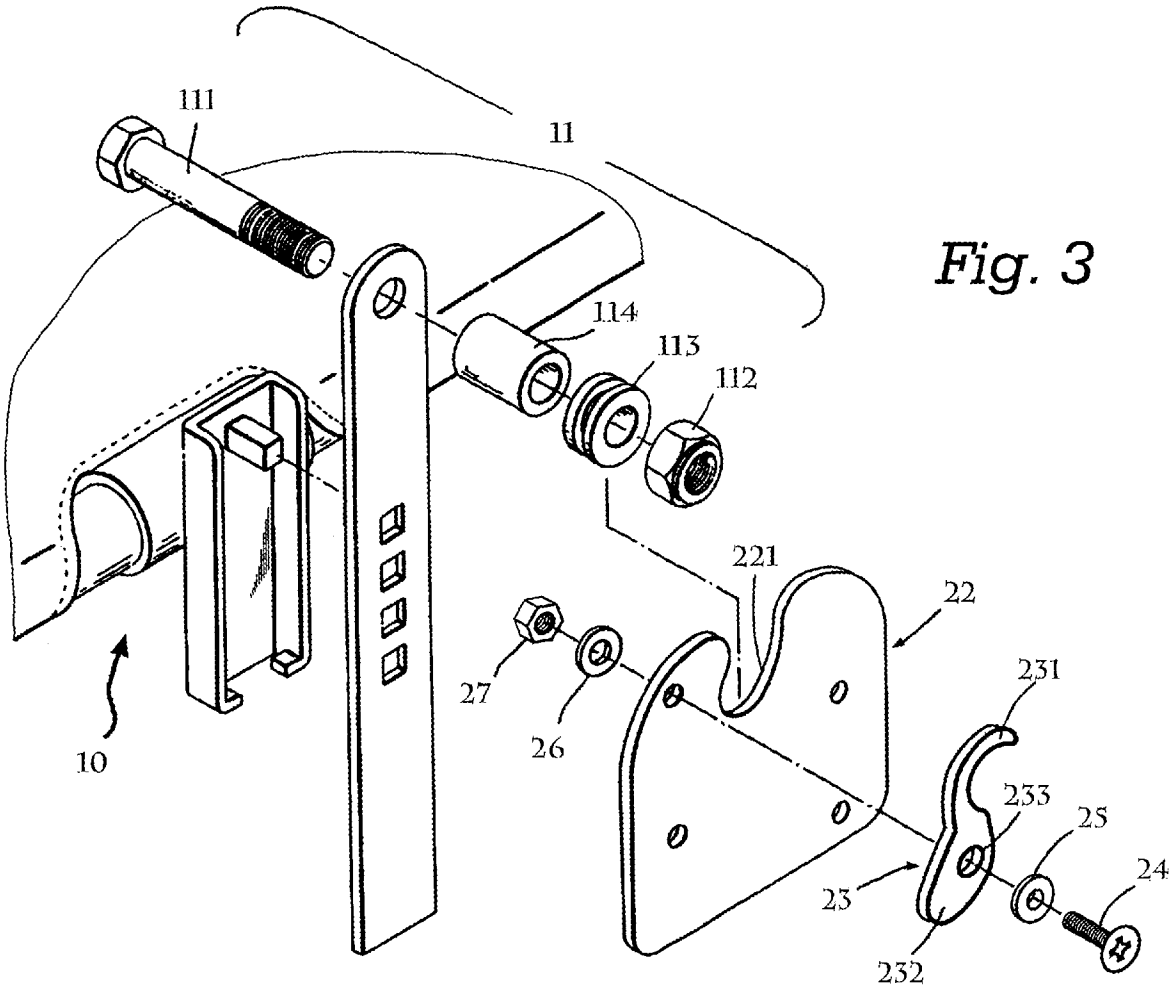
FIG. 3 shows an exploded view of a portion indicated by a circle A as shown in FIG. 2.

The tilting inversion frame 10 comprises on each side a trunnion set 11 on which the tilting inversion frame 10 can pivot relative to the supporting mount 20. Now referring to FIG. 3, the trunnion set 11 further includes an axial bolt 111, a nut 112, a grooved roller 113 and a spacer 114. The trunnion-bearing plate 22 has a blind slot 221, the width of which is barely larger than the diameter of the grooved portion of the roller 113, so as to receive and bear the roller 113 and consequently the axial bolt 111 of the trunnion set 11.

The improvement of this invention lies in that at least one trunnion-bearing plate 22 further includes a keeper 23 coupled to an upper corner of the trunnion-bearing plate 22, which is movable relative to the trunnion-bearing plate 22 between locking position preventing respective trunnion set 11 from being removed from bearing engagement with the trunnion-bearing plate 22 and open positions in which the trunnion set 11 can be removed from the trunnion-bearing plate 22. The keeper 23 is pivotally coupled to the trunnion-bearing plate 22 by a bolt 24, a flanged bush 25, a washer 26 and a nut 27 preferably with anti-slip polymer lining. Such coupling means can also practice an adequate frictional force to the keeper 23 to further increase the difficulty for the keeper 23 to be unintentionally moved.

The keeper 23 has at on end a hook portion 231 for securing the roller 113 in its bearing position which is the bottom end of the blind slot 221, at the other end a lever portion 232 extending away from the trunnion-bearing plate 22 to allow easy access for changing positions of the keeper 23, and an axial portion 233 having a through hole for coupling to the trunnion-bearing plate 22.

Figure 4B:
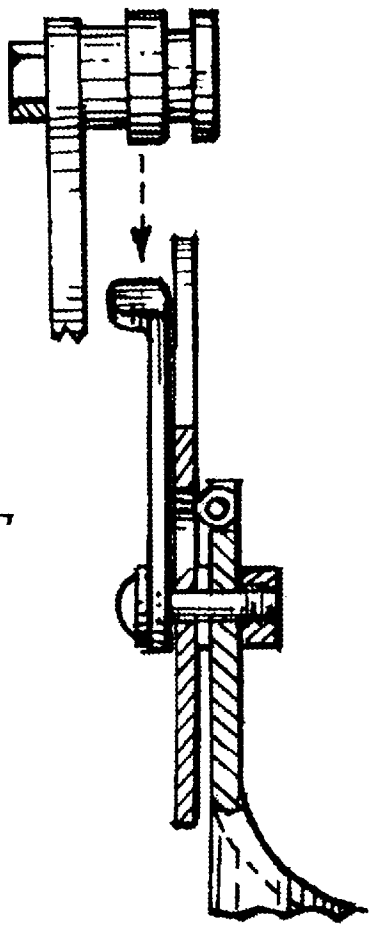
Fig. 4b PRIOR ART
FIGS. 4*a* and 4*b* depict prior art disclosed in U.S. Pat. No. 5,967,956
Figure 4A:
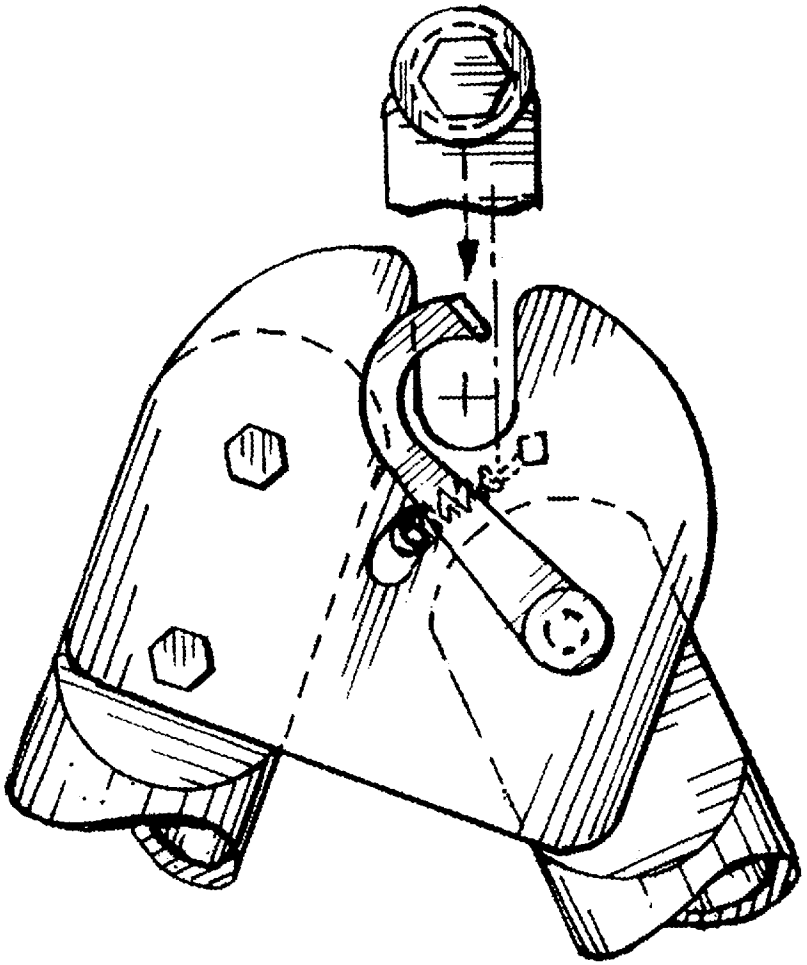

For comparison, please refer to FIGS. 4*a*~4*b*, a tilting inversion exercise table mount is disclosed in U.S. Pat. No. 5,967,956 by Teeter, which employs a spring-bonded keeper for the same purpose. The Teeter device has some drawbacks: 1. The keeper is located between the trunnion-supporting bearing plate and the tilting inversion exercise table, which makes the keeper difficult to access when disengaging the tilting inversion exercise table. 2. The keeper is located on the lower side of the trunnion and therefore has a low visibility; in consequence it is difficult for the user to know if it is in the locking position. 3. The keeper is functional totally depending on the spring mechanism that are interconnected by miniature devices and is relatively unreliable. The spring mechanism again has a low visibility such that a failure thereof is hardly noticeable.

In contrast, the keeper 23 of the present invention is located on the outer side of the trunnion-bearing plate 22 and on the upper side of the trunnion set 11, and has a lever portion 232 extending away from the trunnion-bearing plate 22, therefore providing both high visibility and accessibility. Furthermore, the mechanism of the keeper 23 is so simple and structurally strong that it is much more reliable than the Teeter device.

The lever portion 232 extends away from the trunnion-bearing plate 22 for a length only enough to allow the user, with his finger, to push it down to lever up the hook portion 231, thus allowing disengagement of the trunnion set 11 for dismounting the tilting inversion frame 10. Such length avoids inadvertently bumps and should any bump happen, renders lower torque to the bump in moving the keeper 23. When re-mounting the tilting inversion frame 10, the hook portion 231 is in a higher position than the top edge of the trunnion-bearing plate 22, allowing the user to conveniently push it down to the locking position.

Figure 5C:
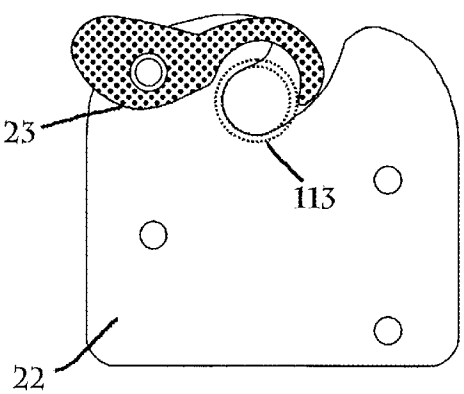
FIGS. 5*a* through 5*c* are schematic views showing the safety keeper moved to different positions.
Figure 5B:
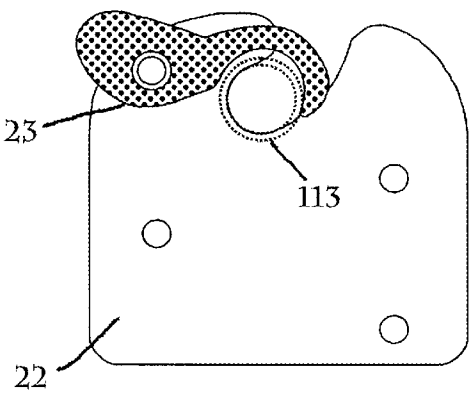
Figure 5A:
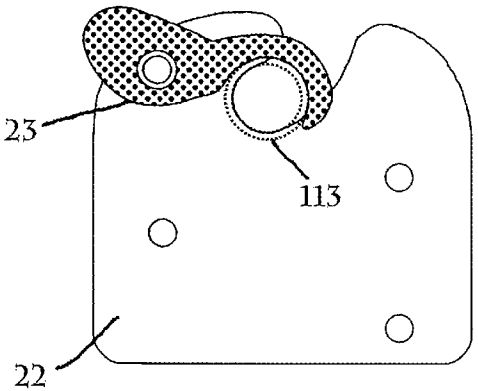

The mechanical principle of the keeper 23 design will now be described with reference to FIGS. 5*a* through 8*c*. FIG. 5*a* shows the roller 113 in bearing position and the keeper 23 in the locking position. FIG. 5*b* and 5*c* show the keeper 23 pivoted upward from the locking position 5 degree and 10 degree respectively. It is shown that during its travel, the keeper 23 is not obstructed by the roller 113 and most importantly, while the roller 113 remains unmoved, there continues to be at least a contact point between the keeper 23 and the circumference of the roller 113 until it is pivoted at least 10 degree from the locking position and the contact point gets always in the way of the roller 113 moving out. This shows that the keeper 23 will not be moved from the locking position by the roller 113 because at least during the first 10 degree of travel of the keeper 23, the roller 113 can not be moved. It is therefore clear that no matter how violent maneuvers the person exercising may execute, the imparted force to the trunnion set 11 including the roller 113 thereof may not force the keeper 23 to move and thereby give way to the trunnion set 11.

Figure 6:
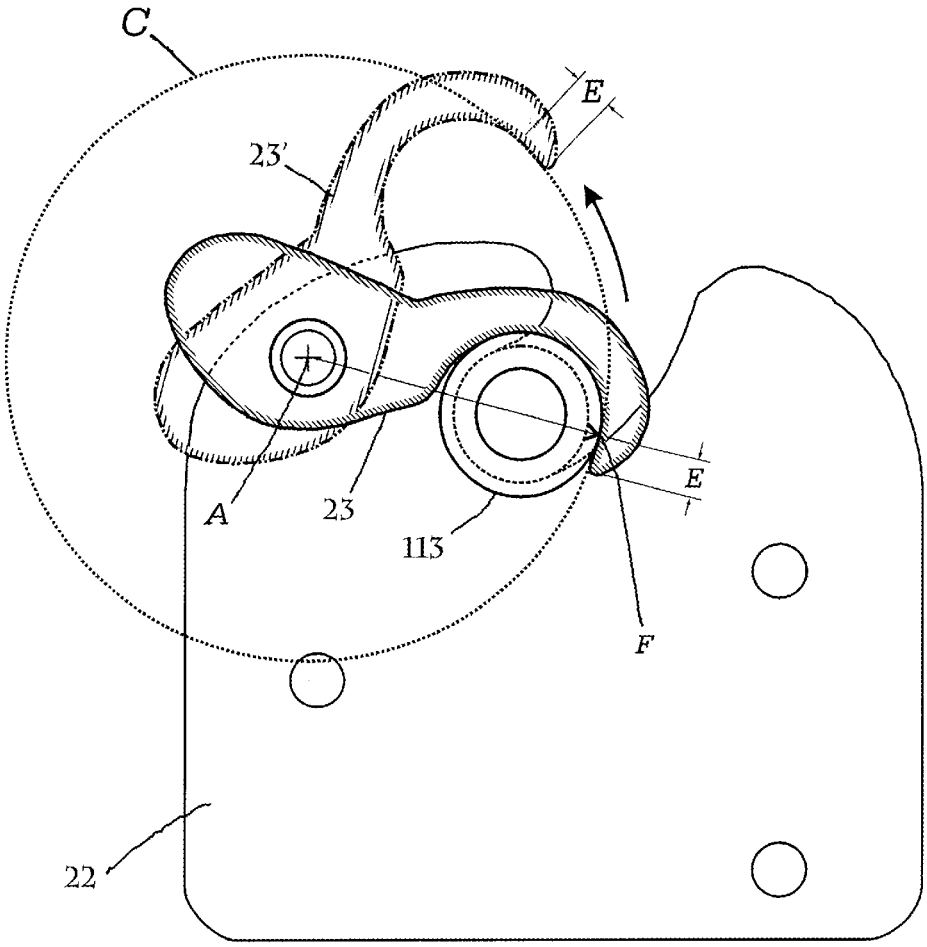
FIG. 6 shows designing principle of the geometry of the hook portion of the keeper.

Referring to FIG. 6, the keeper 23 is shown in the locking position and 60 degree up. The roller 113 has a furthest point F relative to the pivotal axis A of the keeper 23. The imaginary circle C has its center coincided with the pivotal axis A. The hook portion 231 of the keeper 23 has a baring edge E originated from point F and extending downward along the circumference of the imaginary circle C for a certain length. The hook portion 231 lies entirely out of the imaginary circle C so that when it pivots on the axis A, it will never be obstructed by the roller 113. In an other aspect, every point on the baring edge E passes contiguously by the point F and continues to bar the movement of the roller 113.

Figure 7:
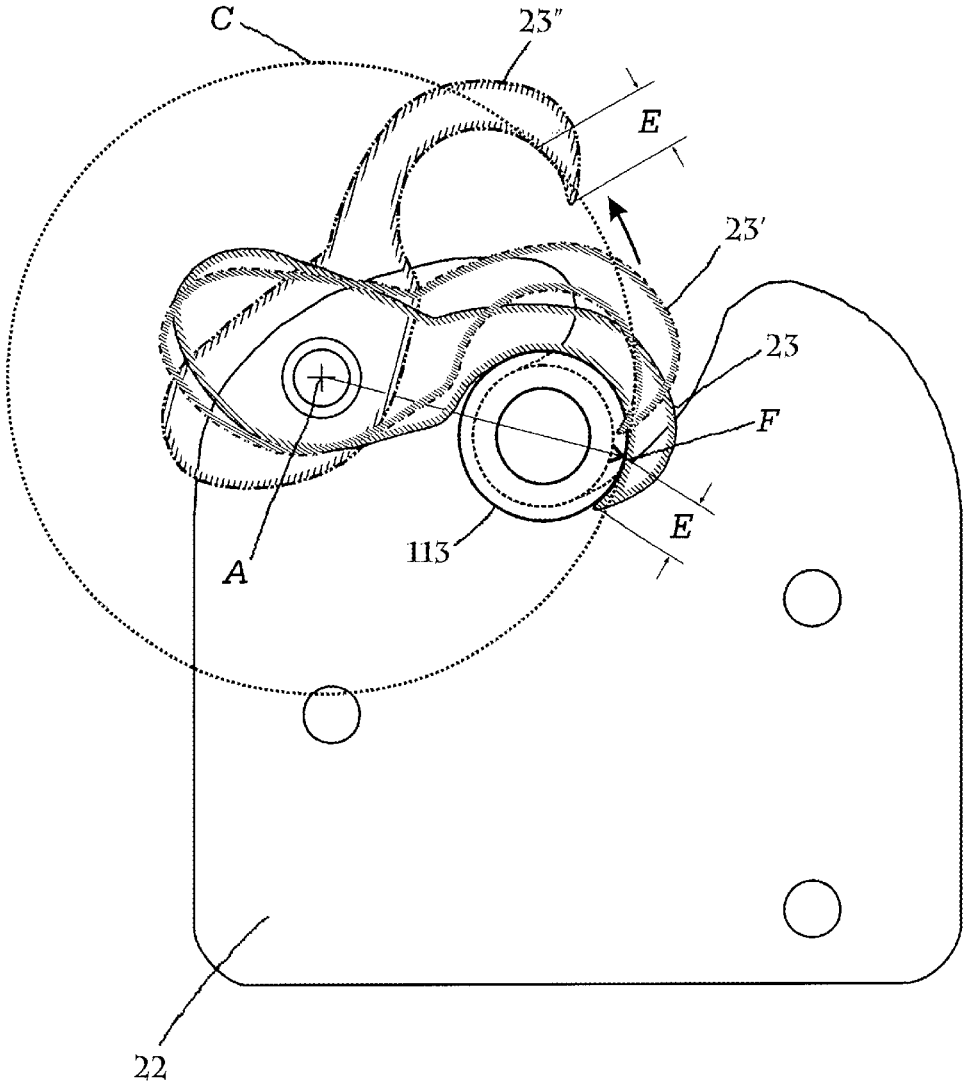
FIG. 7 shows a wrong design of the geometry of the hook portion of the keeper.
Figure 8A:
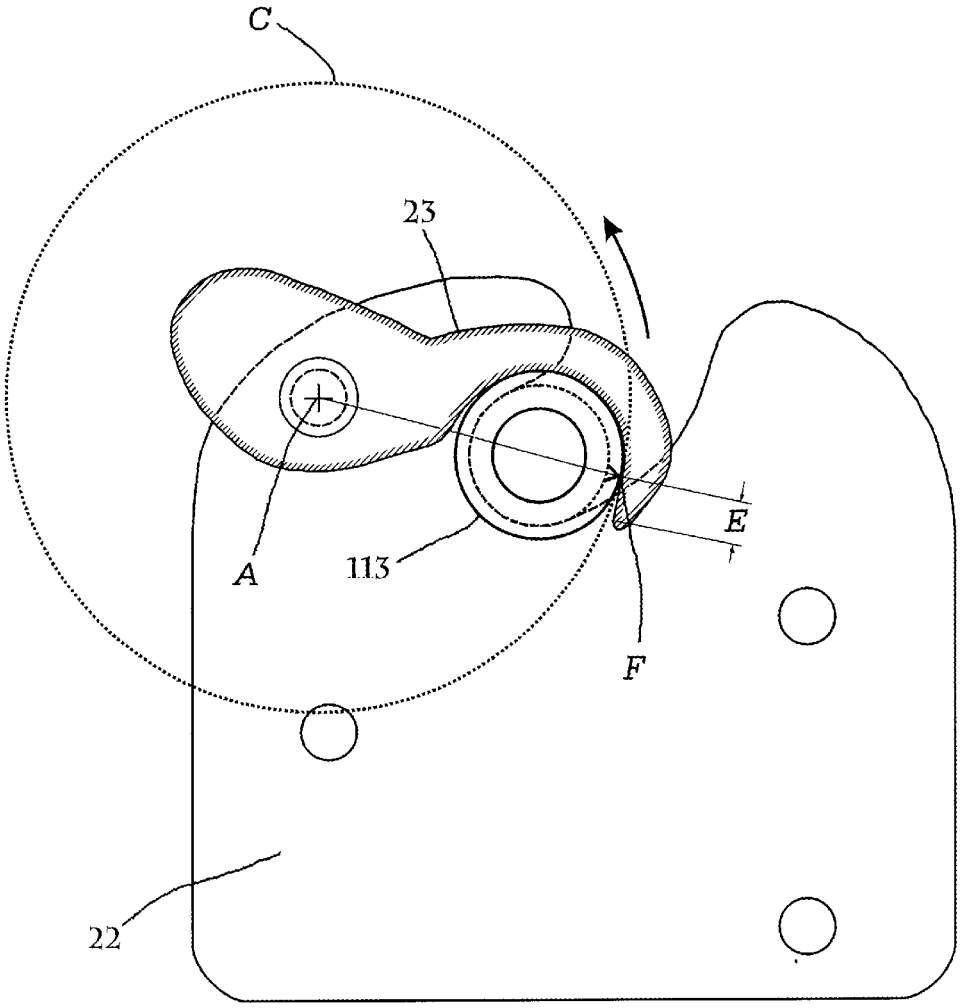
FIGS. 8*a* through 8*c* show another wrong design of the geometry of the hook portion of the keeper.
Figure 8B:
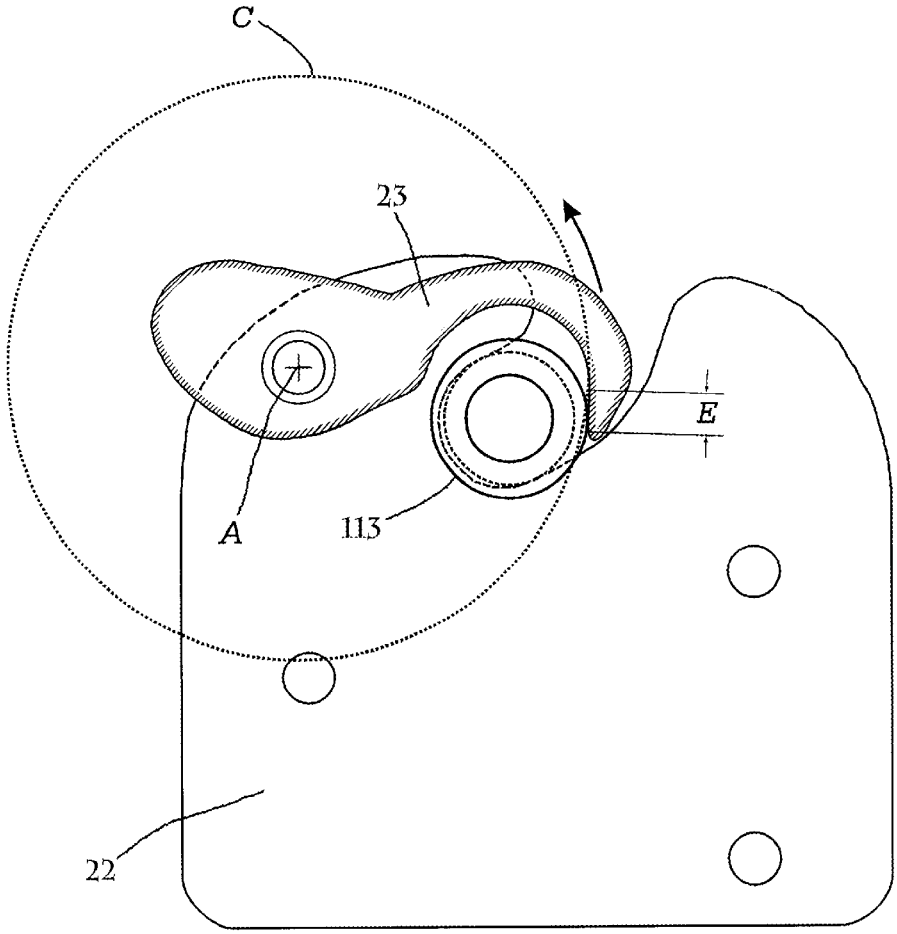
Figure 8C:
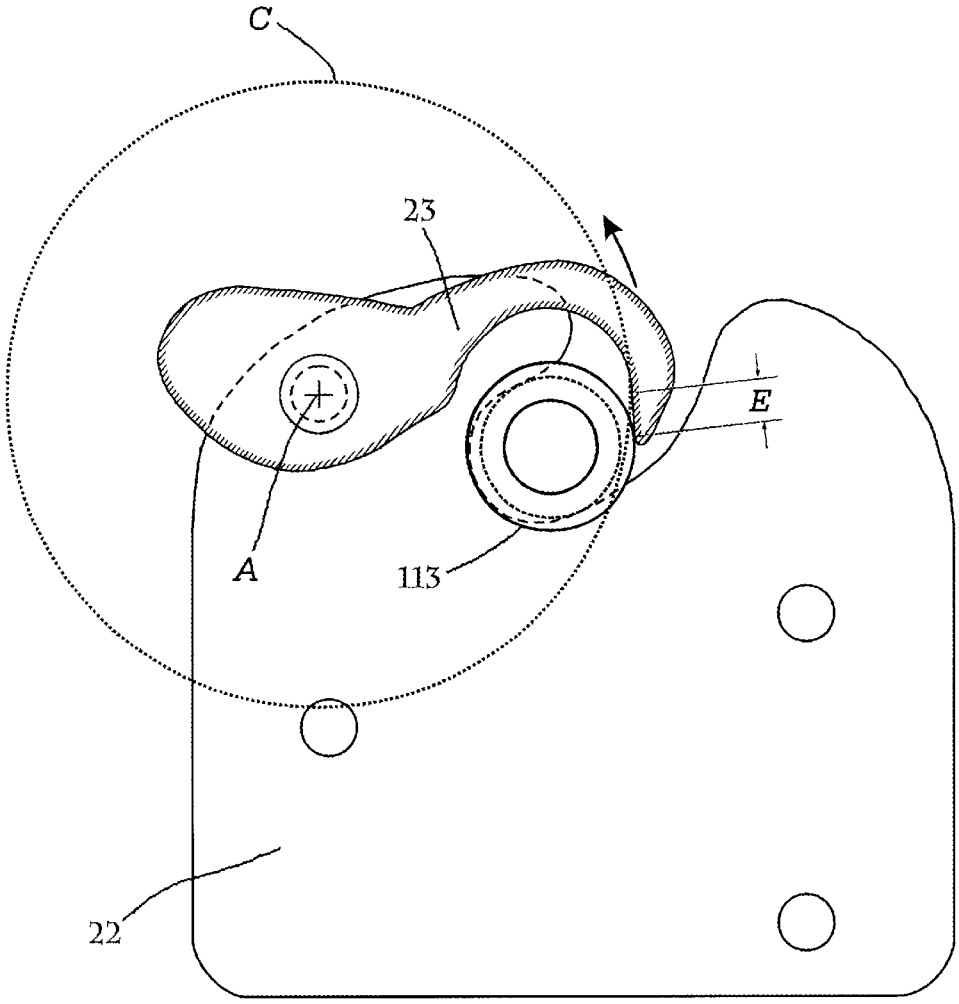

FIG. 7 illustrates a wrong design of the keeper 23 where the baring edge E proximate to the end of the hook portion 231 intrudes into the imaginary circle C. The keeper 23 and the roller 113 would be interposed when the roller 113 is in bearing position and the keeper 23 is in the neighbourhood of the locking position. Such design will not work. FIGS. 8*a* through 8*c* illustrate another wrong design where the baring edge E proximate to the end of the hook portion 231 is biased away from the circumference of the imaginary circle C. In FIG. 8*b*, the roller 113 has been moved a little away from the bearing position and the keeper 23 moved 10 degree upward from the locking position. The keeper 23 and the roller 113 are not interposed and the baring edge E of the keeper 23 is in contact with the circumference of the roller 113. In FIG. 8*c*, the roller 113 has been moved still a little further away from the position shown in FIG. 8*b* and the keeper 23 is 15 degree upward from the locking position. The keeper 23 and the roller 113 still are not interposed and the baring edge E of the keeper 23 is always in contact with the circumference of the roller 113. FIGS. 8*b* and 8*c* demonstrate concurrences of the outward movement of the roller 113 and upward movement of the keeper 23 thereby prove that the roller 113 (and the trunnion set 11 in general) may be pushed outward (by violent maneuvers the person exercising), causing the keeper 23 pivoting upward. In other words, the keeper 23 can not prevent the trunnion set 11 from being removed from bearing engagement with the trunnion-bearing plate 22.

What is claimed is:

1. A supporting mount for a tilting body inversion frame having standing means and spaced trunnion-bearing plates in an elevated position for bearing the trunnions carried by the tilting body inversion frame, wherein each of the trunnion-bearing plates has a blind slot for receiving and bearing the trunnions, at least one of the trunnion-bearing plates further include a keeper movable relative to the trunnion-bearing plate between locking position preventing respective trunnion from being removed from bearing engagement with the trunnion-bearing plate and open positions in which the trunnion can be removed from the trunnion-bearing plate, characterised in that the keeper has at one end a hook portion which in locking position secures the respective trunnion in bearing engagement and at the other end a lever portion extending away from the trunnion-bearing plate, and in-between an axial portion through which the keeper is pivotally connected onto the outer side and proximate to the upper end of the trunnion-bearing plate.

2. The supporting mount of claim 1, wherein the keeper receives a frictional force when it is moved.

* * * * *